United States Patent [19]

Nicholson

[11] 4,011,131

[45] Mar. 8, 1977

[54] LUBRICATED SUCTION BOX COVER

[75] Inventor: Charles B. Nicholson, Glens Falls, N.Y.

[73] Assignee: Albany International Corporation, Albany, N.Y.

[22] Filed: Aug. 6, 1975

[21] Appl. No.: 602,357

[52] U.S. Cl. ..... 162/279; 162/275; 162/374

[51] Int. Cl.[2] ..... D21F 1/52

[58] Field of Search ..... 162/279, 275, 352, 374, 162/199, 217

[56] References Cited

UNITED STATES PATENTS

| | | | |
|---|---|---|---|
| 1,216,861 | 2/1917 | Shorey et al. | 162/374 X |
| 1,822,363 | 9/1931 | Morin | 162/374 |
| 2,487,202 | 11/1949 | Wadleigh | 162/374 |
| 2,905,241 | 9/1959 | Smith | 162/279 |
| 2,934,143 | 4/1960 | Hornbostel | 162/374 X |
| 2,981,329 | 4/1961 | Justus | 162/217 |

*Primary Examiner*—S. Leon Bashore
*Assistant Examiner*—Richard V. Fisher
*Attorney, Agent, or Firm*—Quarles & Brady

[57] ABSTRACT

A suction box cover for a Fourdrinier papermaking machine includes a leading portion having a top surface which supports a travelling Fourdinier fabric. The leading portion has a channel across its length which includes a lower manifold region and an upwardly projecting throat region that opens upon the fabric supporting surface. A lubricating fluid is fed to the manifold region and flows upwardly through a series of orifices in a metering member retained within the channel to the fabric supporting surface to lubricate the fabric.

8 Claims, 9 Drawing Figures

LUBRICATED SUCTION BOX COVER

BACKGROUND OF THE INVENTION

This invention relates to suction boxes, and more particularly to a cover for a suction box having a water feeding unit near its leading edge.

Fourdrinier machines deposit paper pulp on a fast moving foraminous belt known as a Fourdrinier fabric and water is drawn out of the pulp through the fabric to set up the initial paper sheet. Such machines are provided with suction boxes positioned after a series of table rolls, or foils, and they function to remove water from the paper sheet by utilizing a vacuum pump to obtain a pressure difference between the top and bottom surfaces of the forming paper sheet. Water is then drawn through the Fourdrinier fabric into the suction box, and by virtue of the suction effect the paper and paper sheet are held tightly against the suction box surface over which the fabric is travelling.

Since the fabric may travel over the suction boxes at rather high speeds, the frictional engagement between the fabric and the suction box may cause severe wear of the fabric and substantially reduce its useful life. Also, suction box covers can become excessively worn, thus necessitating maintenance to preserve an even fabric supporting surface throughout their extent, since the wear often is irregular over the surface area, or in aggravated cases replacement of the complete covers becomes necessary. As another consequence, frictional drag on the fabric may result in substantial increased power consumption for driving the fabric around the Fourdrinier machine.

The amount of frictional drag and wear of a fabric varies considerably from one Fourdrinier machine to another. In some machines the paper sheet will contain more water than in other machines when moving over the suction boxes, and the water flow will provide a wet operation in which wear and frictional drag of the fabric are quite small. In other machines, the water flow out of the sheet is less and the machine operation is quite dry in the vicinity of the suction boxes. Then friction between fabric and suction box is a greater problem.

The degree of wetness, or dryness, can also vary between suction boxes of a single machine. The paper sheet progressively becomes drier as it proceeds over the boxes, and it is even possible to visually observe a dry line extending transversely across the paper sheet which is drier to one side than the other. Thus, fabric wear and frictional drag are factors that may present greater problems in some installations than others.

To circumvent these difficulties, suction box covers which are presently commonly formed of a high density polyethylene material have been subjected to "fly cutting"—the cutting of small curved grooves in the surface. These grooves might acquire moisture from the underside of the fabric which would provide lubrication between the fabric and the cover surface. Another prior construction has been the installation of shower sprays in advance of suction boxes to spray water against the fabric bottom to clean off small paper fines. Some of the applied water may be retained by the underside of the fabric for lubrication over the suction box cover, however, most of the water would be doctored off the fabric by the leading edge of the suction box. This construction has not been intended as a means of reducing friction between a fabric and a suction box. Thus, neither practice has accomplished a successful lubrication, and these wear problems continue to plague the papermaking industry.

Although these problems are currently encountered with Fourdrinier machines equipped with suction boxes having high density, polyethylene covers, the perplexing wear problems have early antecedents with metal box covers. In the patent issued to Shorey, et al., U.S. Pat. No. 1,216,861 on Feb. 20, 1917, a metal trough fastened to the leading edge of a metal suction box cover has a pipe through which water flows and is delivered to the underside of the fabric before it passes over the suction box cover. The water is introduced onto the fabric to lubricate it prior to travel over the suction box cover to ameliorate the wear problems discussed heretofore. The present invention lubricates the wire to overcome these problems, but the construction utilized is intended to improve upon the Shorey et al. arrangement to provide a construction that achieves a substantially uniform application of lubricant to the fabric across the suction box length, and that is, in a preferred form, specially useable in plastic covers.

SUMMARY OF THE INVENTION

The present invention contemplates a suction box having an improved mechanism for lubricating the underside of a Fourdrinier fabric, and it more specifically resides in a suction box cover having a leading portion with a fabric supporting surface and a channel in its interior, the channel having a lower manifold region for receiving a lubricating liquid and a throat region extending upward from the manifold region which opens upon the fabric supporting surface. A metering member is located in the channel intermediate the manifold region and the opening of the throat region, and has a series of orifices for admitting lubricant flow out of the manifold region to the fabric supporting surface.

In a preferred form, the channel extends throughout the length of the leading portion. The preferred lubricant, water, is fed to the manifold region through each channel end. The supplied water passes through the orifices in the metering member in accordance with the flow effect desired. The member comprises either a flat strip or an elongated block structure having orifices which may be spaced and sized to achieve a substantially equal water distribution to the fabric supporting surface across the cover length.

Accordingly, it is an object to provide a suction box cover incorporating a structure for lubricating a fabric passing over the cover to diminish the wear on the fabric, cover and Fourdrinier machine.

It is a further object to provide a metering member for the suction box cover that achieves a substantially uniform feed of lubricant to the fabric underside.

A further object is to reduce the frictional drag of a Fourdrinier fabric travelling over suction boxes to lower the power requirements of the Fourdrinier machine.

It is another object to provide a metering member in the suction box cover which is readily removable to facilitate maintenance and cleaning of stock which may build in the orifices, on other parts of the member or in the throat region of the channel.

It is still another object to provide a lubricant feeding structure for a suction box cover to substantially lessen the amount of maintenance required on the cover and the frequency of its replacement due to the frictional drag of a passing fabric; and to accomplish this objective by using a lubricating structure that is relatively inexpensive and can be incorporated into presently existing suction box cover designs.

The foregoing and other objects and advantages of the invention will appear from the following description.

In the description reference is made to the accompanying drawings which form a part hereof, and which there is shown by way of illustration and not of limitation a number of preferred embodiments of the invention. Such embodiments do not represent the full scope of the invention, but rather the invention may be employed in a variety of forms, and reference is made to the claims herein for interpreting the breadth of the invention.

DESCRIPTION OF THE PREFERRED EMBODIMENTS

Figure 1:
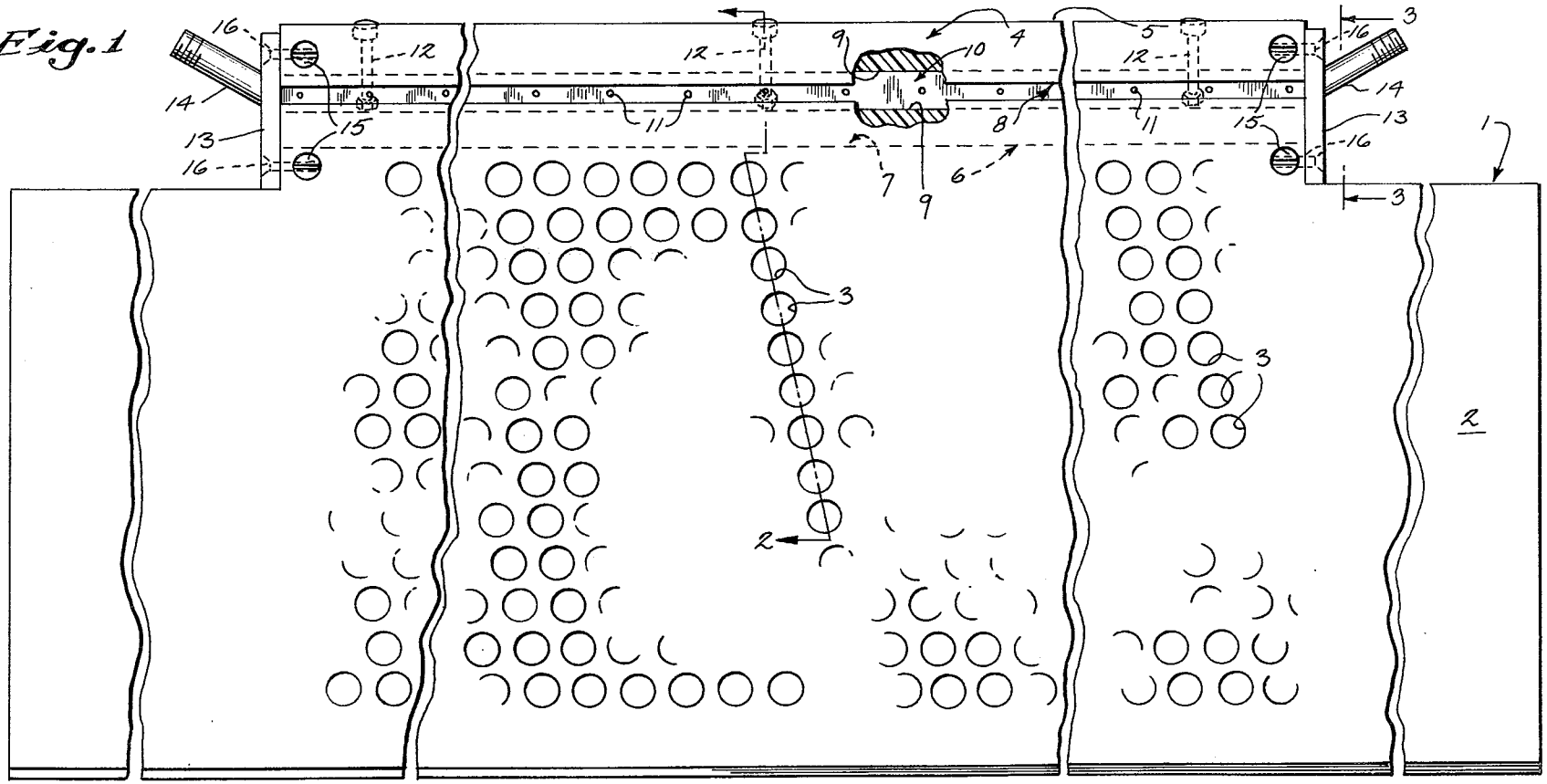
FIG. 1 is a top view of a suction box cover incorporating the present invention.
Figure 2:
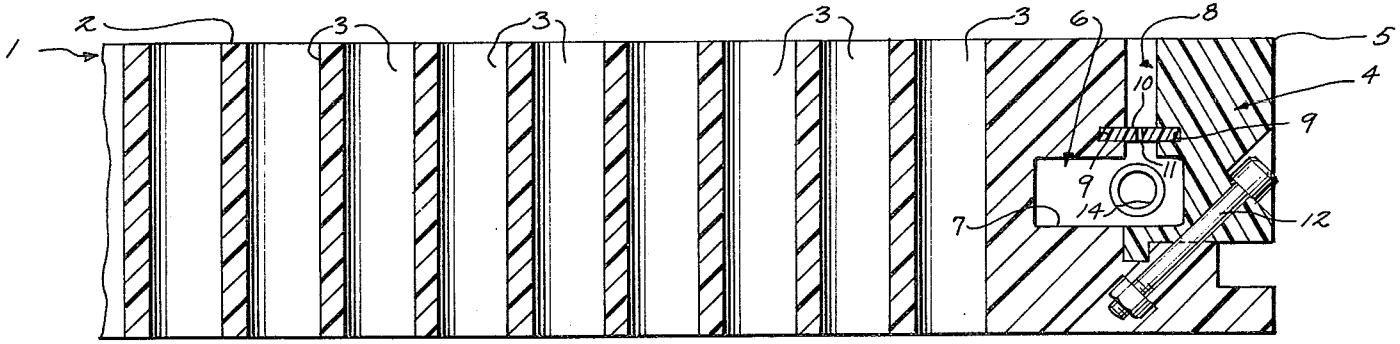
FIG. 2 is a view in cross section of a portion of the suction box cover taken along the plane of the line 2—2 shown in FIG. 1.

Referring to FIGS. 1–4 of the drawings, there is shown a cover 1 for a suction box of a Fourdrinier papermaking machine, which cover can either be an integral part or a removable component of the suction box. The cover 1 has a top, or Fourdrinier fabric supporting surface 2, and the cover 1 is preferably composed of a high density, ultrahigh molecular weight polyethylene material. As shown in FIGS. 1 and 2, the cover 1 has numerous circular suction openings 3 through which water is withdrawn from a travelling fabric (not shown) by a vacuum or pressure differential in conventional fashion. The openings 3 may also take the form of slots, which is a common alternative construction.

Figure 3:
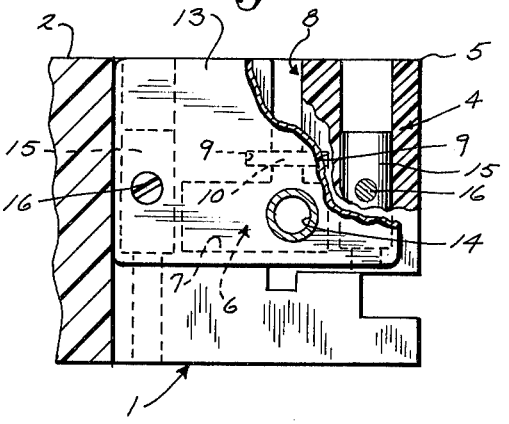
FIG. 3 is a fragmentary end view showing the leading portion of the suction box cover.

The cover 1 has a leading portion 4 to the front of the suction openings 3 that faces an oncoming fabric. This leading portion 4 is slightly shorter than the full length of the cover 1, as illustrated in FIG. 1. There is a leading edge 5 which makes initial contact with an advancing fabric, and the lateral extent of this edge 5 is greater than the width of the fabric, so that the ends of the leading portion 4 will extend outward of the side margins of the fabric. A deep channel 6 is formed in the leading portion 4 which extends longitudinally along its entire length. The channel 6 is sub-divided into two primary regions, as shown in FIGS. 2 and 3, which comprise a relatively large lower, or manifold region 7 to which lubricating water is introduced and an upper throat region 8 of lesser width into which water is introduced from the manifold region 7. The throat region 8 opens at its top upon the fabric supporting surface 2, so that lubricating water may be fed from the channel 6 to this surface 2. A pair of transverse mounting grooves 9 are formed in the side walls of the throat region 8 to form mortises that face each other, and which receive and retain a strip-like water metering member 10. The lengthwise edges of the member 10 form tenons that are received within the mortise grooves 9 with a snug fit. The metering member 10 can be slid into place, and it is formed essentially of the same polyethylene material of which the cover 1 is formed. The metering member 10 also has a plurality of orifices 11 spaced along its length that control the flow of water from within the manifold region 7 to the upper reaches of the throat region 8.

The channel 6 can be integrally formed in a cover leading portion 4 that comprises a single piece, or as shown in FIGS. 1–3 the leading portion 4 may be made up of two components bolted together. The set of assembly bolts and nuts 12 shown in these figures are equally spaced along the length of the front of the cover 1, and the bolts pass through the leading portion 4 diagonally downward so as to avoid intersection with the channel 6. Preferably, the bolt heads and nuts 12 are countersunk so as to eliminate any protruding parts. Bolts and nuts 12 also may be advantageously employed in a single piece leading portion 4, as well as in the two component portions illustrated in the drawings. A polyethylene material of which the leading portion 4 is fabricated can lose a degree of its rigidity in the presence of hot water, and to maintain structural integrity in the thin wall created between the channel 6 and the front of the leading portion 4, so as to insure maintenance of the metering strip 10 in its position, a set of bolts 12 may be employed.

At each side, or end of the leading portion 4 there is a sealing plate 13 that closes over the end of the channel 6, and in each plate 13 there is threaded an inlet nipple 14 for introducing a supply of lubricating water into the manifold region 7 of the channel 6. In order to firmly anchor the sealing plates 13 in place, metal, circular cylindrical anchors 15 are inserted in appropriate cavities in the polyethylene cover material, and mounting screws 16 passing through the plates 13 are threadedly received in the anchors 15.

In operation, water is fed from a suitable water supply at a controlled rate to both ends of the channel 6 through the inlet nipples 14. The water enters the manifold region 7, and flows upwardly through the metering member 10 into the throat region 8. Since the metering member 10 resides at a level beneath the fabric supporting surface 2, a pond of water accumulates above the member 10 and is continually fed to sustain its depth. The upper surface of the pond is thus maintained flush with the surface 2, so that the underside of a Fourdrinier fabric travelling across the suction box cover 1 will be able to pick up water and develop a thin film on its knuckle surfaces that will lubricate the interface between the fabric and the suction box.

Figure 4:
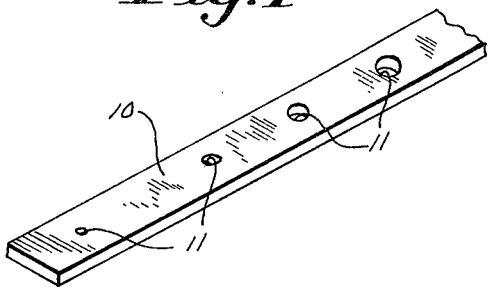
FIG. 4 is a view in perspective of an insert member used in the suction box cover.

The size and spacing of the orifices 11 affect the flow rate and distribution of water across the throat region 8. By varying the siace and placement of orifices 11 in a member 10, the rate of water entry into the throat region 8 may be varied along the length of the channel 6. For example, to increase the amount of water applied to the fabric at a particular location, the number or size of the orifices 11 can be increased. This feature is illustrated in FIG. 4, in which the orifices 11 shown in the metering member 10 are unequally sized and spaced. The size of the orifices 11 and the spacing between successive orifices 11 can be varied throughout the channel length in any selected manner. Since the metering member 10 is slidably removable from the mortise grooves 9, the orifice arrangement of a specific member 10 can be substituted for that of another member 10. In this manner the flow characteristics can be altered to achieve a uniform flow across the channel or some other desired flow characteristic.

Figure 5:
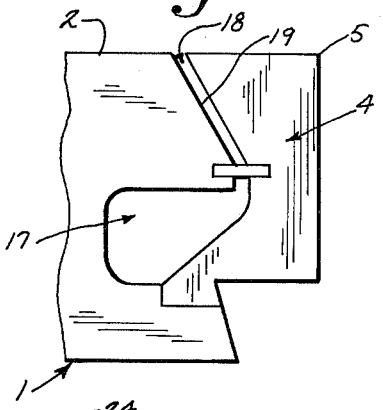
FIG. 5 is a fragmentary end view with end plate parts removed showing a second embodiment of the invention.

FIG. 5 shows a modified channel construction in which a channel 17 has a throat region 18 extending obliquely to the rear, rather than perpendicularly. This may reduce any "doctoring" of paper stock by the throat edge 19 that might occur, and also enhance the pick up and entrainment of water by the underside of the fabric. It should be apparent to those skilled in the art that other effects can be achieved by further modifications in the channel configuration.

Figure 6:
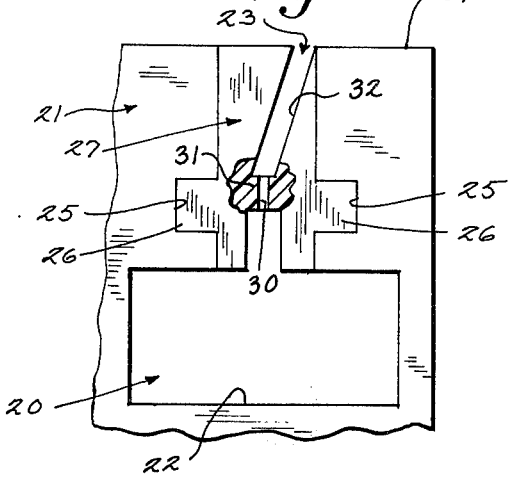
FIG. 6 is another fragmentary end view in partial cross section of a suction box cover comprising a third embodiment of the invention.
Figure 8:
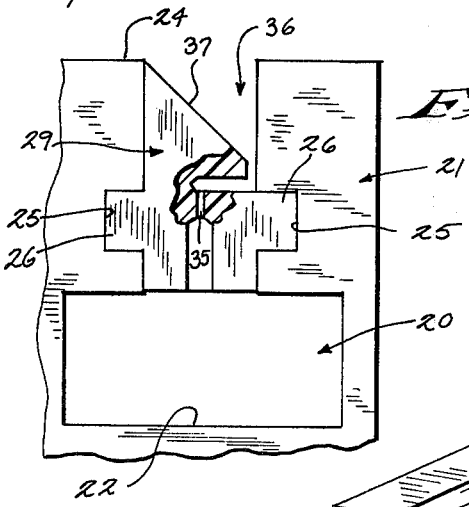
FIG. 8 is a fragmentary end view in partial cross section similar to FIG. 6, but showing yet another embodiment of the present invention.
Figure 7:
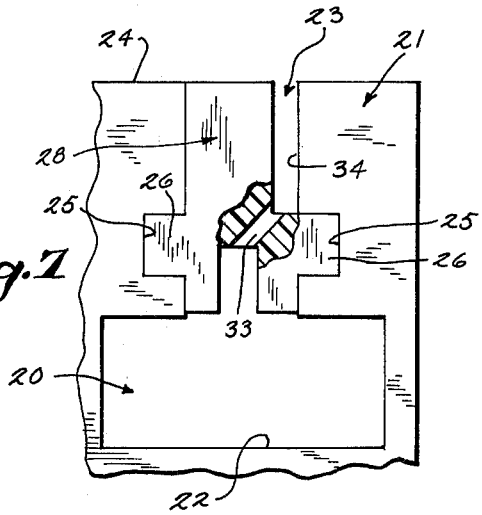
FIG. 7 is a fragmentary end view in partial cross section similar to FIG. 6, but showing a fourth embodiment of the present invention.

Referring now to FIGS. 6–9, a family of related embodiments are shown. In each of these figures similar parts have the same reference numerals. A channel 20, similar to channel 6 in the first embodiment, is integrally formed in a cover portion 21. This channel 20 has a manifold region 22 and a throat region 23 which projects upwardly towards a fabric supporting surface 24. The throat region 23 has a pair of horizontal grooves, or mortises 25, each formed in one of its side walls. In FIG. 6, these mortises 25 receive tenons 26 of a water metering member 27 that fills most of the throat region 23. Similar metering members 28 and 29 are shown in FIGS. 7 and 8, which have like tenons 26. These metering members 27–29 are elongated block-like structures, as contrasted with the thin strip-like metering member 10 of FIGS. 1–5, and they are also preferably constructed of a high density, ultrahigh molecular weight polyethylene material.

Figure 9:
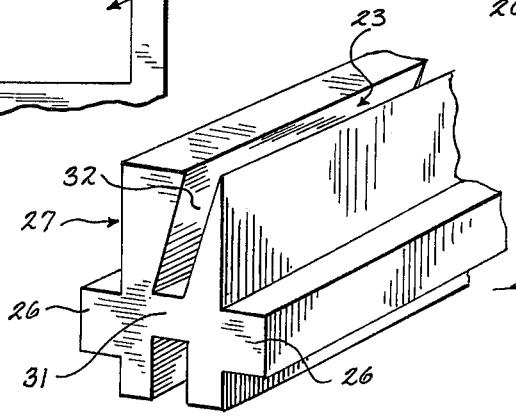
FIG. 9 is a view in perspective of a fragmentary length of the metering member of FIG. 6.

Referring particularly to the metering member 27 of FIG. 6, which is also shown in perspective in FIG. 9, there is a plurality of orifices 30 spaced along a central web 31. Each orifice 30 communicates at its lower end with the manifold region 22 and at its upper end with a slot 32. The slot 32 is formed wholly within the metering member 27, extends the full length of the channel 20, and constitutes an alternative manner of constructing a water holding pond. The slot 32 also extends upwardly obliquely terminating at the fabric supporting surface 24, so that the narrow pond has a surface flush with the underside of a fabric. Lubricating water is fed in the same manner as in the first embodiment, to both ends of the channel 20, and flows through the orifices 30 into the slot 32 building into and maintaining a pond to lubricate the underside of the fabric.

In FIG. 7, orifices 33 in the metering member 28 communicate at their upper ends with a slot 34 having side walls perpendicularly intersecting the fabric supporting surface 24. The metering member 28 is readily removable and replaceable with a metering member having a different slot width. The slot 34 has one wall formed by the cover portion 21, so that variation in slot width can be readily adjusted by machining the slot wall formed by the member 28.

With reference to FIG. 8, the inserted metering member 29 has a plurality of orifices 35 leading into a throat region 36 that has its entire width open at the top to present a relatively large pond surface. The metering member 29 has an oblique surface 37 which provides this structural result. Thus, upon feeding water through metering member 29, a pond forms that may yield a greater amount of water to the underside of a fabric.

The invention provides a lubrication system for a suction box that is an integral part of the box cover, or top. A pond of water is created, just aft of the cover leading edge that feeds water to the underside of the Fourdrinier fabric without any stream force that might impinge high velocity water on the underside of the forming paper sheet. Injury to the paper sheet is thus avoided. Water pick up for lubrication will occur from a gentle emergence of the water out of the pond, and also from entrainment forces developed by the fast moving Fourdrinier fabric across the suction box surface.

The water flow can be regulated by use of unique metering members positioned between water flowing into a channel in the cover structure and the upper surface of the pond. The metering members have orifices that can be varied both in diameter and spacing, so that the water flow into the pond can be at a uniform rate along the entire length of the lubricating channel. The length of a suction box can be very substantial and hence uniform flow to achieve like lubrication across the entire length of the suction box is necessary. The present invention is directed to achieving this goal.

I claim:

1. A fabric lubricating structure for a suction box comprising:

a cover having a leading portion with a fabric supporting surface, and including a channel in the interior thereof;

means for introducing a fabric lubricating liquid into said channel;

said channel having a lower manifold region for receiving fabric lubricating liquid, and a throat region extending upward from the manifold region which opens upon said fabric supporting surface; and a metering member mounted in said channel and located intermediate said manifold region and the opening of said throat region, which metering member has a series of orifices to control the flow of lubricating liquid from said manifold region to said throat region to maintain the surface of the lubricating liquid in said throat region flush with said fabric supporting surface.

2. The fabric lubricating structure as recited in claim 1, wherein the opening in said throat region obliquely intersects said fabric supporting surface.

3. The fabric lubricating structure as recited in claim 1, wherein said metering member defines a slot which communicates with the orifices in said metering member and which opens to said fabric supporting surface.

4. The fabric lubricating structure as recited in claim 3, wherein said slot has a side wall which obliquely intersects said fabric supporting surface.

5. The fabric lubricating structure as recited in claim 3, wherein the width of said slot is substantially the same as the width of said throat region.

6. The fabric lubricating structure as recited in claim 1, wherein said orifices in said metering member have unequal diameters and are unequally spaced throughout said member to achieve a substantially uniform flow of lubricant to said fabric supporting surface across the length of said leading portion.

7. A fabric lubricating structure for a suction box comprising:

a cover having a leading portion with a fabric supporting surface, and including a channel in the interior thereof;

means for introducing a fabric lubricating liquid into said channel;

said channel having a lower manifold region for receiving fabric lubricating liquid, and a throat region extending upward from the manifold region which opens upon said fabric supporting surface; and a metering member mounted in said channel and located intermediate said manifold region and the opening of said throat region, which metering member has a series of orifices for admitting lubricant flow out of said manifold region to said fabric supporting surface;

said metering member including a pair of lengthwise tenons formed on opposite sides thereof; and said throat region including a pair of laterally opposed mortises, each of which recieves one of said tenons to retain said metering member within said throat region.

8. The fabric lubricating structure as recited in claim 7, wherein said leading portion has a plurality of reinforcers spaced along its length to secure the retention of said metering member within said throat region.

* * * * *